United States Patent [19]

Pederson et al.

[11] Patent Number: 4,664,631

[45] Date of Patent: May 12, 1987

[54] SURROGATE WEAPON FOR WEAPONS EFFECTS SIGNATURES

[75] Inventors: Robert J. Pederson, Thousand Oaks; Lawrence J. Gallagher, Arcadia; Jack V. Miller, Sierra Madre; Lauren B. Althaus, Montclair; Benjamin Rubinstein, La Crescenta; Stephen N. Schomotolocha, Thousand Oaks, all of Calif.

[73] Assignee: Loral Electro-Optical Systems, Inc., Pasadena, Calif.

[21] Appl. No.: 793,671

[22] Filed: Oct. 31, 1985

[51] Int. Cl.[4] ..... F41F 27/00; F41F 1/04

[52] U.S. Cl. ..... 434/16; 89/7

[58] Field of Search ..... 434/11, 16; 89/7, 14.2; 42/54, 55, 57, 58

[56] References Cited

U.S. PATENT DOCUMENTS

| | | | |
|---|---|---|---|
| 2,094,854 | 10/1937 | Smith | 89/7 |
| 2,425,975 | 8/1947 | Witte et al. | 89/7 |
| 3,728,937 | 4/1973 | Nelson et al. | 89/7 |
| 4,416,630 | 11/1983 | Hagen | 434/16 |

OTHER PUBLICATIONS

The Condensed Chemical Dictionary, Sixth Edition, 1966. Title and Subsequent Page, p. 724 G.A.U. 223.

*Primary Examiner*—William H. Grieb

*Attorney, Agent, or Firm*—Spensley Horn Jubas & Lubitz

[57] ABSTRACT

The invention comprises a surrogate weapon for simulating the sound and flash of gunfire having a combustion chamber system in which a primary chamber is an elongated cavity, having a proximal end closed with a head and an open distal end. A combustible mixture is injected via electronically timed hydrocarbon fuel and oxidizer pulses into the combustion chamber near the closed end through an annular injector having a plurality of spaced apart fuel and oxidizer nozzles. The fuel nozzles are axially spaced from the oxidizer nozzles and are closer to the head. Thus the injected fuel/oxidizer charge is stratified with a fuel concentration distribution preferentially being richer at an ignition source near the head. The open distal end of the combustion chamber is in the form of an annular convergent nozzle which also comprises the proximal end of a secondary chamber that is acoustically tuned and provided at its open distal end with an annular muzzle having a cross-sectional shape capable of controlling the fundamental frequency and modifying tuned frequency overtones of the acoustic signature.

One embodiment provides the fuel nozzles as a plurality of radial grooves on the proximal side of a generally flat plate transverse to the primary combustion chamber cavity and having an aperture therethrough, the aperture being flush with the inner surface of the combustion chamber cavity, and also providing oxidizer nozzles as a plurality of radial grooves on the distal side of the flat plate.

30 Claims, 16 Drawing Figures

LIVE AMMO

BLANK AMMO

PRESENT INVENTION

SURROGATE WEAPON FOR WEAPONS EFFECTS SIGNATURES

BACKGROUND OF THE INVENTION

Marksmanship training in the use of automatic weapons, such as machine guns, has been widely accomplished in recent years using lasers instead of bullets for scoring. This is done to solve problems related to both economy and safety. A machine gun capable of firing a thousand rounds of ammunition a minute can consume thousands of dollars in ammunition in a single day's service on a gunnery range, and also can represent a substantial hazard in the hands of inexperienced trainees.

The employment of a laser beam that is aligned with the weapon's sight offers a solution to both of the above problems by providing a means of showing where the gun is aimed during firing, but it does not provide any realism for the shooter in terms of sound (peak pressure in db and timbre), flash and smoke. Therefore a common practice has been to fire blank ammunition in these guns to make the training more realistic. This practice enhances safety by eliminating the actual bullets, but it requires the use of ammunition casings, primers, wadding and powder; as well as continuing the need for loading, handling and cleaning up brass after firing. Misfires of automatic weapons are common, as blanks have only a marginal amount of energy to reliably reload the chamber. Therefore it is still a costly method of providing realism for training.

More recent training systems have included automatic weapons effects signature simulators to provide the sound (db and timbre), flash and smoke for laser firing simulated machine guns. These devices operate by injecting pulses of a combustible gaseous fuel and an oxidizer into a combustion chamber and then igniting the mixture with a spark plug. In this manner the use of real or blank ammunition is replaced with fuel and oxidizer, pulsed under pressure into a combustion chamber through trigger operated solenoid valves.

Previously known prior art weapons effects simulating combustion chambers have had somewhat limited performance, due to the improper design of the injectors and combustion chamber. In order to meet the real weapon requirements of sound pressure level during high firing rates typical of automatic weapons, injection and mixing of fuel and oxidizer must be accomplished in a turbulent fashion, followed by ignition and rapid transition to a combustive detonation wave. This detonation wave provides the necessary high muzzle pressure-temperature energy release, which creates the required acoustical/visual signatures. Two necessary conditions must be satisfied to support the development of a detonative wave. First, the mixture ratio of fuel and oxidizer near the spark plug must be within flammability limits to initate and propagate the deflagration flame front. Second, for the deflagration flame front to rapidly transition to a detonation wave the fuel/oxidizer mixture ratio in the confined volume of combustion chamber must be within the detonation limits.

A related problem in prior art weapons effects simulating combustion chambers has been in the tendency for the combustion flame to flash back through the fuel injectors, nozzles and manifolds, disrupting operation and creating a safety hazard.

Also prior art weapons effects simulators have not been able to accurately produce the sound level, fundamental frequencies, overtones and muzzle flash made by actual guns. A skilled observer can acoustically distinguish types of real weapons from a considerable distance, and it is a vital training element to learn to identify the lethality of weapons types before entering into engagement in combat. It would be disastrous to a trainee to learn and become familiar with weapons signatures during training that were different in terms of distance, range, caliber and lethality than the real weapons to be encountered in combat.

Presently known weapons effects simulators also have been physically larger than the real weapons, making the firing of such simulators unrealistic for trainee shooters. This has greatly diminished the value of training by failure to provide a realistic surrogate weapon that can develop familiarity and skill that is transferable from the surrogate to the actual combat weapon. Not only are prior art simulators oversized, but a number of them have been unable to operate at low temperatures; as they have employed fuels, such as propane or butane, that will not boil to provide adequate gas pressure at the subfreezing temperatures that are considered normal for weapons operation.

SUMMARY OF THE INVENTION

It is the purpose of the present invention to provide a realistic surrogate weapon to simulate automatic weapon acoustical and visual signatures, including an injector capable of separately injecting fuel and oxidizer into a combustion chamber to establish a fuel/oxidizer mixture ratio distribution that is within the ignition flammability and detonation limits; whereby the mixture ratio is ignited with a spark plug to provide a safe, reliable, repeatable and efficient pulse detonation combustion, and precluding combustion flame flashback from propagating back through the injector nozzles and into the fuel supply components.

It is a further purpose of the invention to provide a surrogate weapon having a combustion chamber system that accurately produces a specific signature for a weapon, in terms of sound level, fundamental frequencies, overtones, muzzle flash and smoke.

It is yet another purpose of the invention to provide a surrogate weapon having a combustion chamber system with the actual weapon's specific signature performance in the size and external configuration of the real weapon, and operable in the environmental temperature extremes appropriate for the actual weapon that is simulated.

The achievement of the foregoing purposes of the present invention is only accomplished through detailed understanding of the operating characteristics of the actual weapons simulated, and then integrating all the optimized components together into a surrogate weapon. Each component design has required extensive parametric studies and operational testing to determine the individual component characteristics and the effect of component variables on the overall system performance. Although there is some subjectivity in the human perception of sound, it requires meticulous attention to both analytical and experimental data to reproduce a weapons signature having many individual dominant acoustic frequencies at the correct sound pressure level, including the overtones that provide timbre associated with a specific weapon. At the same time the visual flash and smoke signature must also be replicated by providing plume afterburning along with precise control of the internal combustion, and not degrading the acoustic performance.

The present invention herein disclosed has been shown to produce surrogate weapons that have signatures recognizable enough to be indistiguishable from the actual live firing weapons to trained and trainee observers. This has been accomplished by the combination of a tuned primary combustion chamber having the fuel/oxidizer charge from closely regulated external tanks, configured by spaced sonic-velocity injection nozzles, to provide a easily ignited rich mixture near a spark plug, and propagating to detonative mixture in the rest of the chamber.

A timing sequence from a timing control unit, which is operated by a trigger and has an external source of electrical power, controls the injection of pulses of fuel and oxidizer to produce the proper gas slug sizes using solenoid valves; and initiates the spark to ingnite the charge at the instant of proper fuel/oxidizer mixture distribution within the primary combustion chamber. A separately tuned secondary combustion chamber provides additional tuning, and a family of final muzzle adapters adds control of overtone and visual plume characteristics of each weapon type.

DETAILED DESCRIPTION OF THE DRAWINGS

Figure 1:
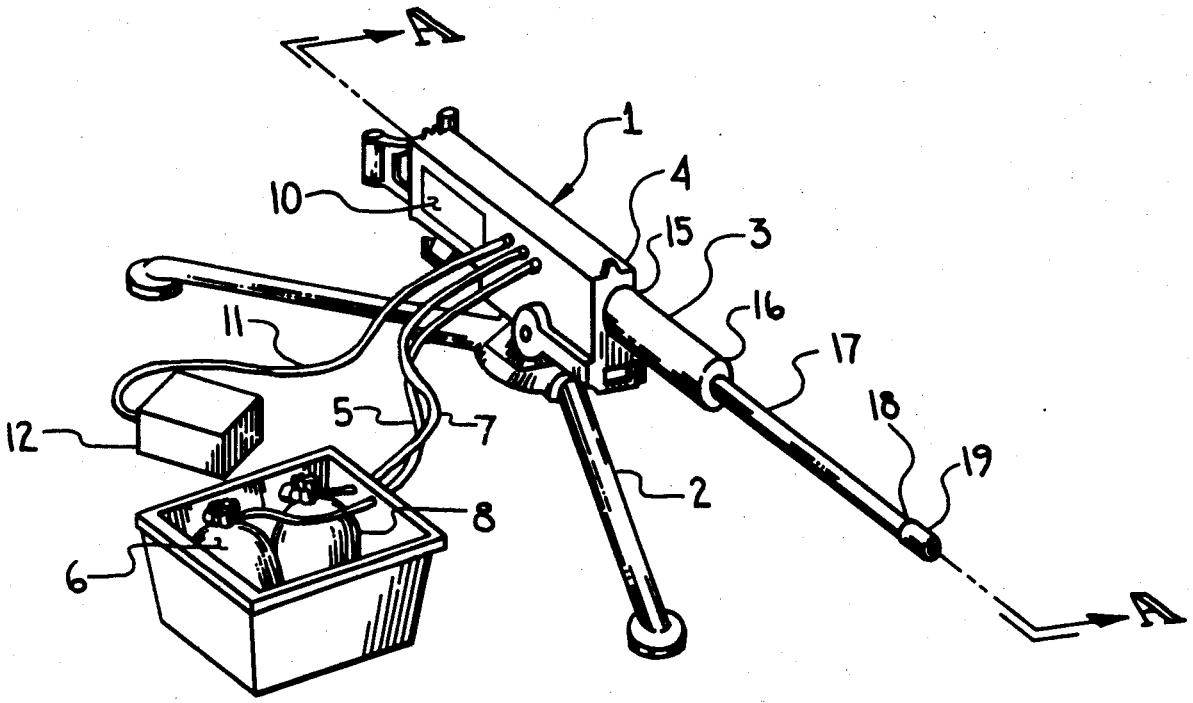
FIG. 1 is a perspective view of a weapon surrogate according to the invention.

In FIG. 1 a surrogate weapon 1 according to the invention is mounted on a support means 2 and is shown having a primary combustion chamber 3 attached to a manifold 4. The manifold 4 is supplied by a fuel line 5 from a source of pressurized fuel 6, and an oxidizer line 7 from a source of oxidizer 8. An electrical pulse generator 10 is supplied through an electrical cable 11 from an external source of power 12. The primary combustion chamber has a proximal end mounted to manifold 4 and a distal end 16 supporting a secondary chamber 17, having a distal end 18 provided with a muzzle 19.

Figure 2:
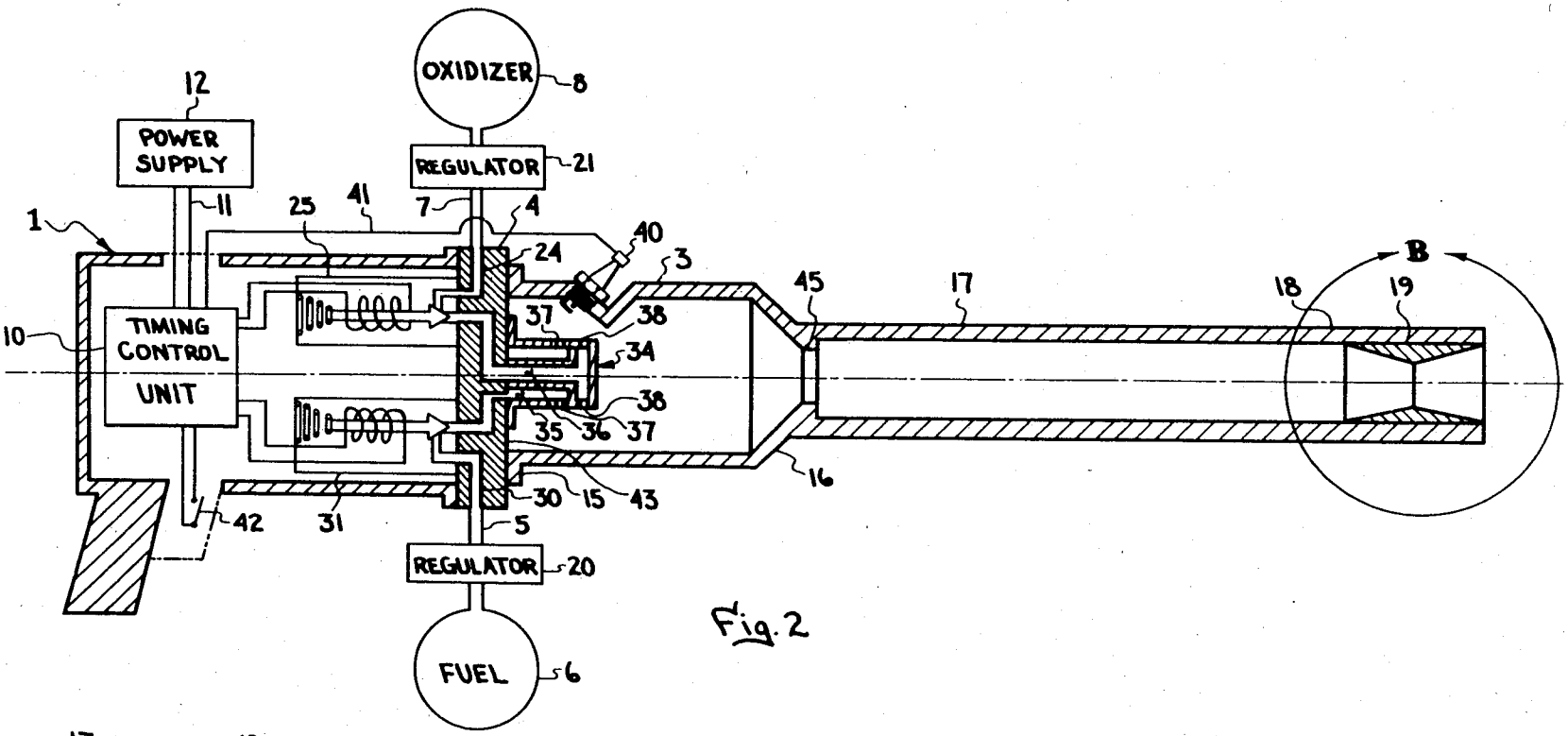
FIG. 2 is a schematic cross-sectional view of a preferred embodiment of the weapon surrogate of FIG. 1, taken along section line A—A.

In FIG. 2 the surrogate weapon 1 is shown in schematic cross-section and having the proximal end 15 of an elongated primary combustion chamber 3 which has a volume that is acoustically tuned to match dominant measured frequencies of real weapons acoustic signatures, and is structurally and thermally connected to manifold 4. The fuel line 5 is shown connected to manifold 4, and is fed from a pressurized source of fuel 6 through a pressure regulator 20. The oxidizer line 7 is also shown connected to manifold 4 and is fed from a pressurized source of oxidizer 8 through a pressure regulator 21. The fuel enters manifold 4 through an inlet 24 connected to a fuel solenoid valve 25 which is normally closed. The oxidizer enters manifold 4 through an inlet 30 connected to an oxidizer solenoid valve 31 which is also normally closed. A timing control unit 10 generates electrical pulses that operate solenoid valves 25 and 31 to permit fuel and oxidizer to enter a fuel/oxidizer injector 34 through fuel plenum 35 and oxidizer plenum 36 respectively, and to pass through fuel injector nozzles 37 and oxidizer injector nozzles 38 into primary combustion chamber 3. A number of circumferentially spaced fuel nozzles 37 and a number of circumferentially spaced oxidizer nozzles 38 are sized with respect desired mass flow rates through solenoid valves 25 and 31 flow rates at the pressure supplied by regulators 20 and 21, respectively, to provide flow at least at sonic velocity through the nozzles upon opening of the solenoid valves by the timing control unit 10. The sonic jets then expand supersonically into the primary combustion chamber 3, followed by a supersonic shock system breakdown, thereby providing a highly turbulent mixing of fuel and oxidizer.

A source of ignition is shown in the form of a spark plug 40 electrically connected to the timing control unit 10 by a conductor 41. A trigger 42 is actuated to initiate pulses from the timing control unit 10 to operate the solenoid valves 25 and 31 to inject a combustible mixture of fuel and oxidizer through the bimodal coaxial injector 34. The fuel nozzles 37 are axially spaced closer than the oxidizer nozzles 38 to a head wall 43, whereby the injected mixture is stratified with a fuel concentration being richer near the head wall 43. The open distal end 16 of the primary combustion chamber 3 is provided with an annular convergent nozzle 45 which is also the proximal end of an elongated secondary chamber 17 which is acoustically tuned to match measured dominant frequencies of real weapons. The distal end 18 of the secondary chamber 17 is provided with an annular convergent-divergent muzzle 19 to vary the constriction and re-expansion rate of combustion gases, thereby controlling the fundamental frequency and acoustic overtones of the acoustic signature. The convergent-divergent configuration shown provides overtone modification to very closely duplicate the sound of a real weapon.

Figure 3:
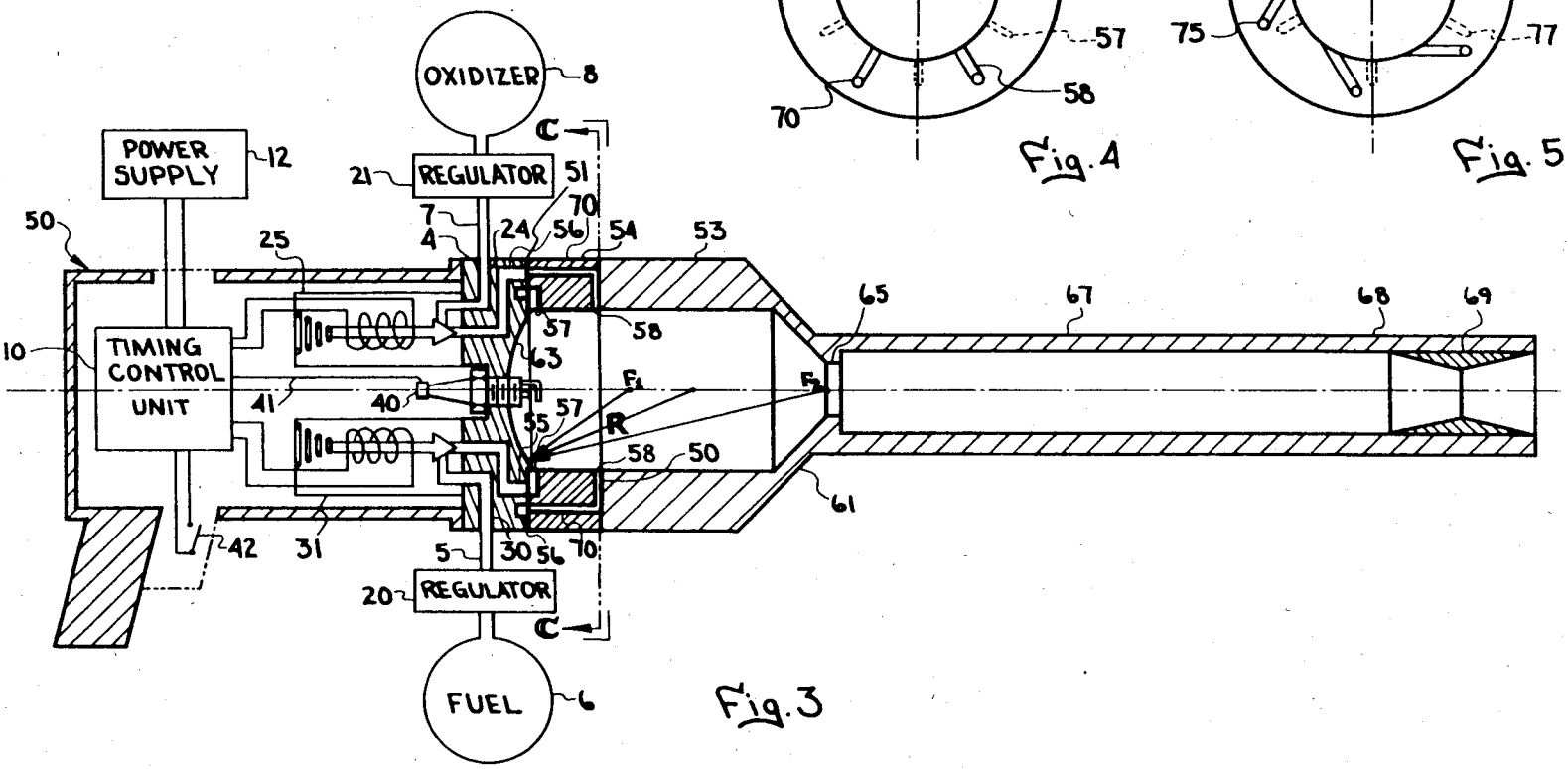
FIG. 3 is a schematic cross-sectional view of another preferred embodiment of the weapon surrogate of FIG. 1, taken along section line A—A.

In FIG. 3 the surrogate weapon 50 is shown in schematic cross-section and having the proximal end 51 of an elongated primary combustion chamber 53 which has a concave head wall 63, and is structurally and thermally connected to manifold 4. The fuel line 5 is shown connected to manifold 4, and is fed from a pressurized source of fuel 6 through a pressure regulator 20. The oxidizer line 7 is shown also connected to manifold 4 and is fed from a pressurized source of oxidizer 8 through a pressure regulator 21. The fuel enters manifold 4 through an inlet 30 connected to a fuel solenoid valve 31 which is normally closed. The oxidizer enters manifold 4 through an inlet 24 connected to an oxidizer solenoid valve 25 which is also normally closed. A timing control unit 10 generates electrical pulses that operate solenoid valves 25 and 31 to permit fuel and oxidizer to enter a fuel/oxidizer injector 54 through fuel plenum 55 and fuel injector nozzles 57, and oxidizer plenum 56 through oxidizer passages 70 and then oxidizer injector nozzles 58 into primary combustion chamber 53.

A number of circumferentially spaced fuel nozzles 57 and a number of circumferentially spaced oxidizer nozzles 58 are flush with the inner surface of the primary combustion chamber 53, and are sized with respect to the pressure supplied by regulators 20 and 21, respectively, to provide the desired mass flow rate through the orifices of solenoid valves 25 and 31 to provide flow at least at sonic velocity through fuel and oxidizer nozzles 57 and 58, respectively, during opening of solendoid valves 25 and 31 by the timing control unit 10.

A source of ignition is shown in the form of a spark plug 40 electrically connected to the timing control unit 10 by a conductor 41. A trigger 42 is actuated to initiate pulses from the timing control unit 10 to operate the solenoid valves 25 and 31 to inject a combustible mixture of fuel and oxidizer through the injector 54. The fuel nozzles 57 are axially spaced closer than the oxidizer nozzles 58 to head wall 63. Therefore the injected mixture is more fuel rich near head wall 63 than near the open distal end 61. The mixture is generally stoichiometric at the spark plug, promoting reliable ignition and rapid axial combustion, transitioning from deflagration to detonation through the primary and secondary combustion chambers. The open distal end 61 of the primary combustion chamber 53 is provided with an annular convergent nozzle 65 which is also the proximal end of an elongated secondary chamber 67, acoustically to measured dominant frequencies of real weapons. The distal end of the secondary chamber 67 is provided with an annular convergent-divergent muzzle 69 to vary the constriction and re-expansion rate of combustion gases, and thereby controlling the fundamental frequencies and modifying the acoustic overtones of the acoustic signature.

The concave energy-reflecting head wall 63 has a radius of curvature R, functioning as a paraboloid to direct enegy generally towards the distal end 61 of the combustion chamber 53, or as a partial elipsoid, whereby energy generally from the center of volume F1 of the primary combustion chamber 53 will be directed towards the center F2 of convergent nozzle 61.

Figure 4:
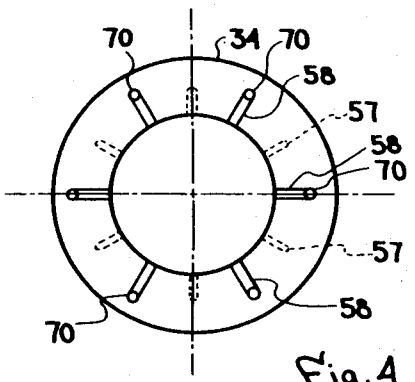
FIG. 4 is a cross-sectional view of a preferred embodiment of the oxidizer injection nozzles taken along section lines C—C of FIG. 3.

In FIG. 4 the distal side of injector 34 is shown as a generally flat plate having a plurality of oxidixer passages 70 therethrough, connecting with the plurality of oxidizer nozzles 58 in the form of radial grooves in the distal side; and the fuel nozzles 57, comprising radial grooves in the proximal side.

Figure 5:
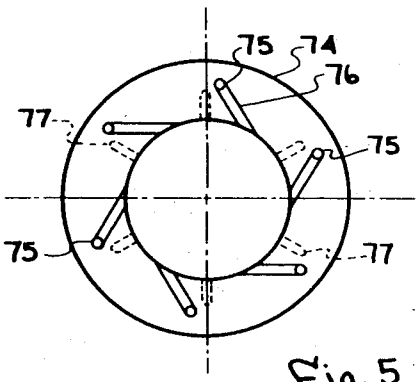
FIG. 5 is a cross-sectional view of an alternate embodiment of the injector nozzles taken along section line C—C of FIG. 3.

In FIG. 5 an alternate embodiment injector 74 is also shown as a generally flat plate having a plurality of oxidizer passages 75 therethrough, connecting with the plurality of spiral grooves 76 at an angle to radials, comprising swirl pattern oxidizer nozzles; and the second plurality of radial grooves 77 in the proximal side, comprising radial fuel nozzles. With the fuel injected radially inward toward the center of the combustion chamber, and the oxidizer injected in a tangential swirl pattern, the fuel/oxidizer mixture is stratified with a fuel concentration near the spark plug and well mixed thereafter in the balance of the combustion chamber volume to produce detonative pulse combustion and efficient combustion-acoustical energy release.

Figure 6B:
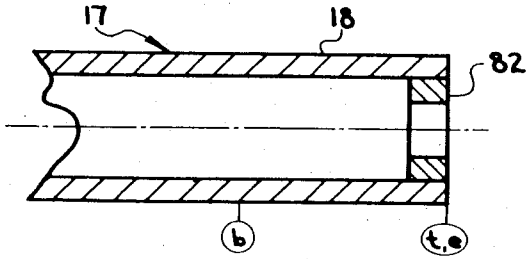
FIG. 6 is a series cross-sectional views of optional alternate muzzles of the embodiment of View B shown in FIG. 2.
Figure 6C:
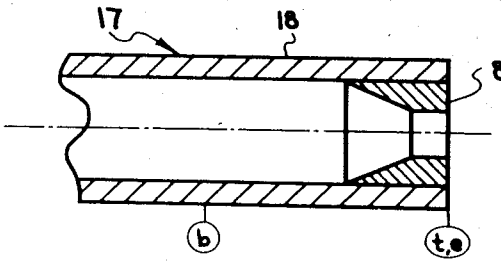
Figure 6E:
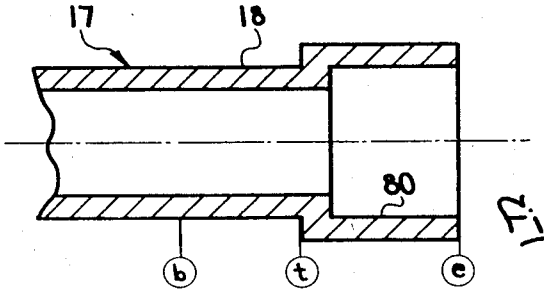
Figure 6A:
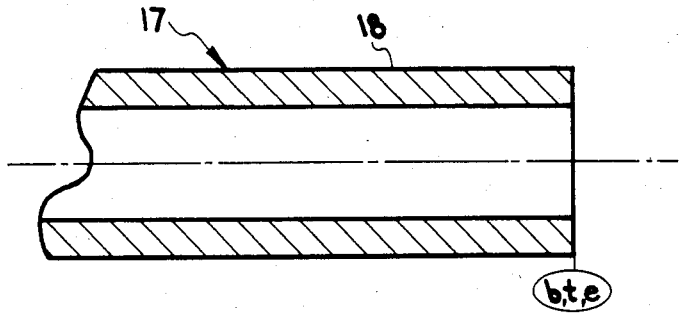

In FIG. 6, views a through g are shown as embodiments which have proven effective in tests to change sound timbre quality by providing a family of muzzle adapters, interchangeable with muzzle adapter 19 of secondary combustion chamber 17 in FIG. 2, or muzzle adapter 69 of secondary combustion chamber 67 in FIG. 3, respectively having optimized the muzzle diameters and internal configurations to adjust the sound frequency power spectrum to match specific weapon signatures, while using a constant and generic barrel diameter as shown in FIG. 6*a*, for the secondary combustion chamber.

FIG. 6*a* shows a base line configuration that produces a booming sound characteristic of 20 mm to 30 mm weapons, with a barrel diameter b, an identical throat diameter t, and also an identical exit diameter e. In FIG. 6*b* barrel diameter b is held constant, and throat diameter t and exit diameter e are reduced as shown. this changes the sound from the booming sound of the 6*a* configuration to a cracking sound characteristic of the firing of a .50 caliber machine gun. Further reduction of the effective throat diameter t and exit diameter e is shown in FIG. 6*c*, which also maintains the same barrel diameter b for the convergent muzzle adapter shown, which further increases the frequencies of the sound signature to the sharper sound of a 7.62 mm weapon. Exit diameter reduction has been found to reduce the db level of the signature significantly, due to reduction in sound pressure levels by acoustical absorption in the gas flowfield. As long as the throat diameter t is smaller than the barrel diameter b, as shown in FIGS. 6*b* and 6*c*, there will always be an acoustic energy loss compared to the baseline configuration of 6*a*.

Figure 6D:
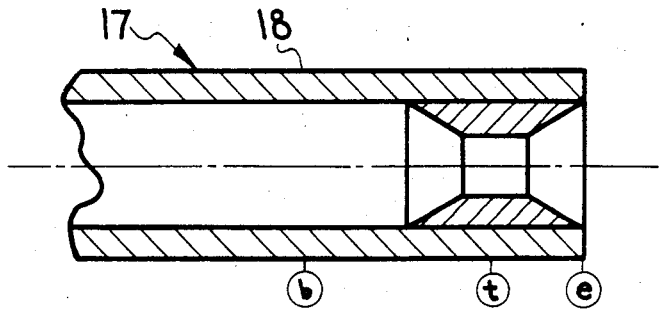

Recovery of the acoustical dissipation through flowfield absorption may be accomplished to reduce the db loss by increasing the exit diameter with respect to the frequency-controlling throat diameter, as shown in FIG. 6*d*, in which the muzzle is shown as convergent to the diameter of 6*c*, but then divergent to re-expand the flowfield to permit recovery of acoustic losses without significantly modifying the sound spectrum.

Figure 6F:
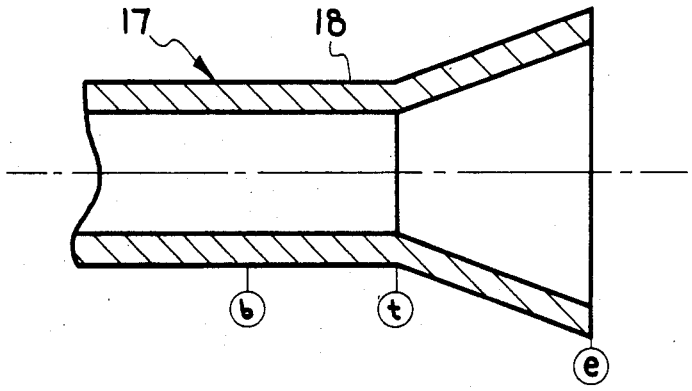
Figure 6G:
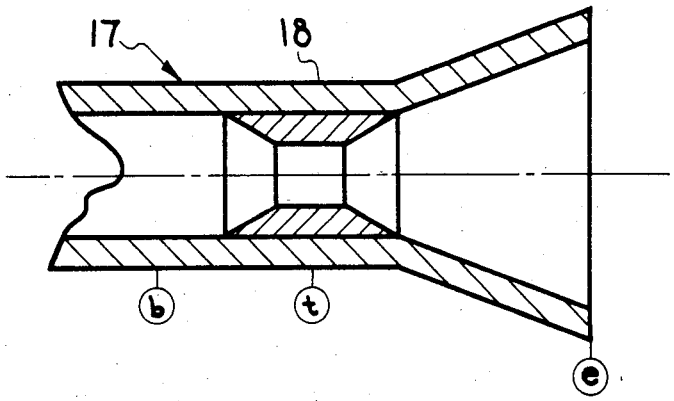

Conversely, test data have shown it is possible to effect a net gain in acoustical energy (db) over the baseline configuration of FIG. 6*a* by reducing the generation of flowfield vortices. This may be accomplished through the use of divergent or expanding exit diameters as shown in FIG. 6*e* through 6*g*, wherein the exit diameter e is larger than the barrel diameter b. This is effective either with the throat diameter t being equal to the barrel diameter b, as shown in 6*e* and 6*f*, or the throat diameter t being smaller than the barrel diameter b, as shown in 6*g*.

The acoustic signature modifications of both frequency and db, achieved by the use of the muzzle configuration shown and described in FIGS. 6*a* through 6*g* have been the result of muzzle change only; with all other operating characteristics of the surrogate weapon remaining unchanged.

Figure 7:
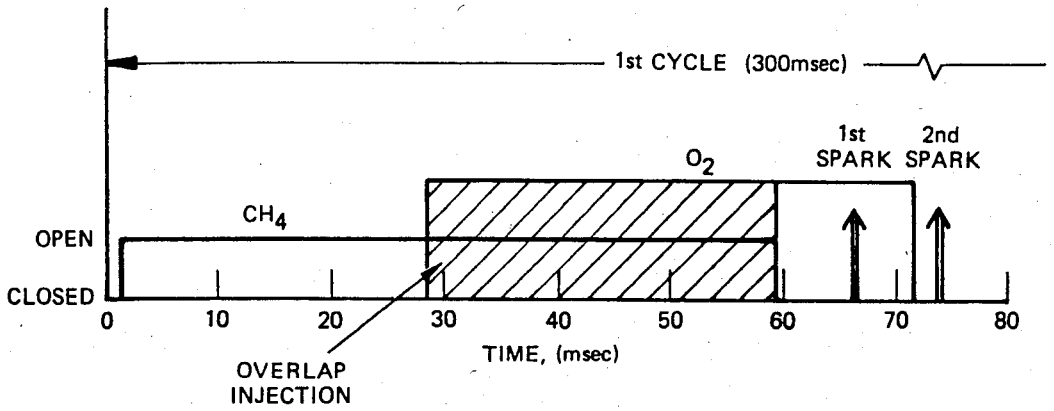
FIG. 7 is a diagram of the solenoid and ignition timing.

In FIG. 7 a typical timing diagram is shown for a surrogate weapon according to the invention, showing the time sequence optimized for the use of Methane as fuel, and oxygen as the oxidizer. The fuel solenoid valve is open for approximately 30 miliseconds when the oxidizer solenoid is opened. Then the fuel solenoid valve is closed at 60 miliseconds, with the oxidizer solenoid valve closing at 72 miliseconds. A first spark occurs at 67 milliseconds, while the oxidizer valve is still open, and a second back-up spark occurs at 74 milliseconds, 2 miliseconds after oxidizer valve closure. This sequence has successfully operated a surrogate automatic weapon at firing rates well over 1,000 rounds per minute with excellent acoustic replication. Muzzle flash simulation and visual spectra have been shown to be controllable through combinations of gas slug sizes and mixture ratios without degrading the acoustical performance. Both gas slug sizes and mixture ratios can be controlled either by varying the gas regulation pressure or the electronic timing.

Figure 8:
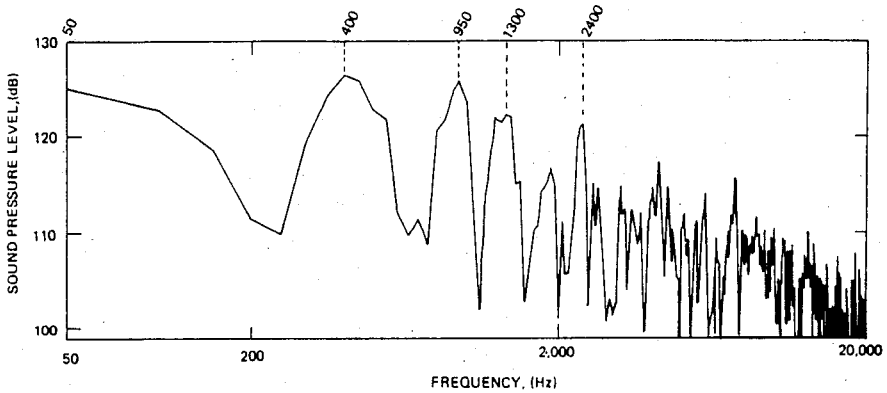
FIG. 8 is a measurement of sound pressure level verses acoustic frequencies for an actual M240 machine gun firing live ammunition.

In FIG. 8 the acoustic signature of an actual M240 machine gun firing live ammunition is shown with sound pressure shown over the range of audible acoustic frequencies.

Figure 9:
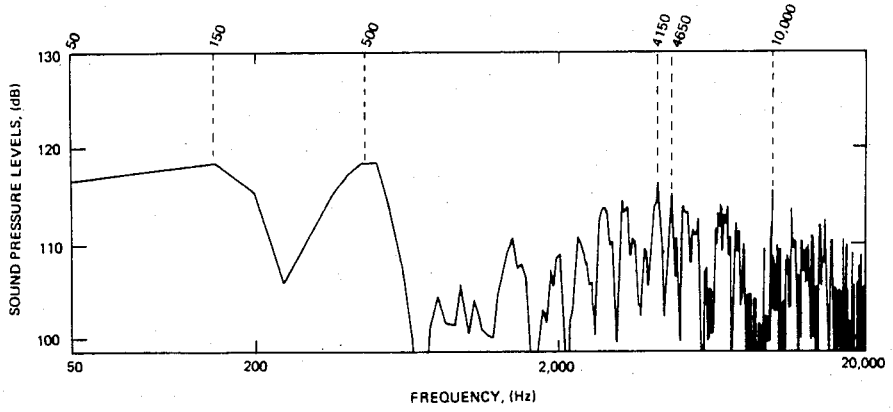
FIG. 9 is a measurement of sound pressure level verses acoustic frequencies for the actual M240 machine gun firing blank ammunition.

In FIG. 9 the acoustic signature of an actual M240 machine gun firing blank ammunition is shown with sound pressure shown over the range of audible acoustic frequencies. The lack of similarity to the signature of the weapon firing live ammunition is clearly apparent, with obvious mismatches and deficiencies.

Figure 10:
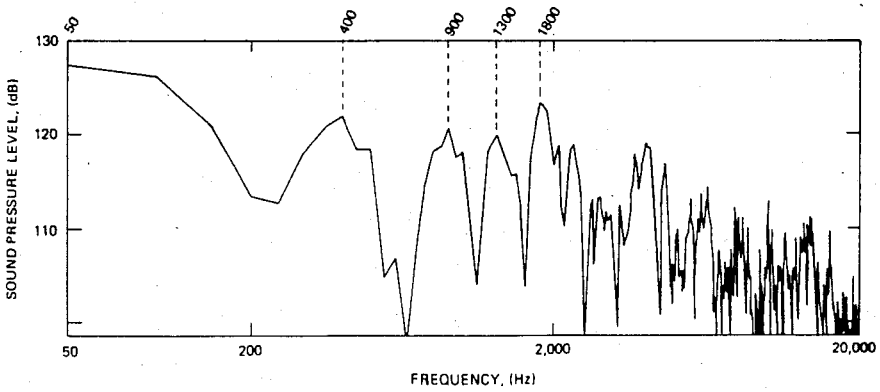
FIG. 10 is a measurement of sound pressure level verses acoustic frequencies for a weapon surrogate for the M240 machine gun made according to the invention.

In FIG. 10 the acoustic signature of an surrogate M240 machine gun according to the invention is shown with sound pressure shown over the range of audible acoustic frequencies. The nearly perfect similarity to the signature of the weapon firing live ammunition is clearly apparent, with virtually exact duplication of both sound pressure level at every audible frequency.

In field test firings trained observers have been unable to distinguish between the real weapon firing live ammunition and the surrogate weapon according to the invention, not only for the 7.62 mm M240 machine guns, but also for the full range of weapons from large bore cannon to small caliber guns. The present invention has demonstrated the ability to accurately replicate the acoustical and visual signatures of virtually any automatic weapon or machine gun through applying the principles herein disclosed to the design of the injector, primary and secondary combustion chambers, muzzle configuration, and by controlling the injection and mixing of proper sized gas slugs, optimizing system pressure, solenoid valve orifices, timing, duration and delay characteristics, along with selection of ignition timing, duration and delay.

We claim:

1. A surrogate weapon for producing weapons effects signatures including:

a primary combustion chamber in the form of elongated cavity having a proximal end closed with a head wall and an open distal end;

an annular injector within the primary combustion chamber having a plurality of circumferentially spaced apart fuel and oxidizer nozzles, the fuel nozzles also axially spaced closer to the head wall;

an electrical timing pulse generator operable from a source of electrical power;

a pressurized supply of fuel and a pressurized supply of oxidizer connected through electrically operable solenoid valves driven by the timing pulse generator and through a manifold to the fuel and oxidizer nozzles respectively within the primary combustion chamber;

an ignition source positioned within the primary combustion chamber and operable at least once by the timing pulse generator at a timed delay following each fuel and oxidizer injection;

a trigger means to initiate a timed pulse sequence from the timing pulse generator to operate the solenoid valves and the ignition source;

a combustion mixture of fuel and oxidizer injected into the primary combustion chamber upon trigger-initiated timed pulses of the solenoid valves and ignited by the ignition source;

an elongated acoustically tuned secondary chamber coaxial with the primary chamber, having its proximal end contiguous with the distal end of the primary chamber; and an annular muzzle at the distal end of the secondary chamber.

2. A surrogate weapon according to claim 1 in which the fuel nozzles comprise a plurality of circumferentially spaced and outwardly radial holes in a cylindrical fuel supply tube which is cantilevered in the distal direction from the headwall, and the oxidizer nozzles comprise a plurality of circumferentially spaced and outwardly radial holes in the tube isolated from the fuel within the tube and connected to a central coaxial oxidizer supply tube within the fuel supply tube.

3. A combustion chamber system according to claim 1 in which the primary combustion chamber is of generally tubular shape having a first open end and a second closed end, the closed end being in the form of an energy reflecting head wall, having means for injecting a fuel and an oxidizer into the chamber without intrusion of the fuel injection means into the combustion chamber.

4. A surrogate weapon according to claim 1 in which the fuel nozzles comprise a plurality of radial grooves on the proximal side of a flat plate transverse to the primary combustion chamber cavity, and having an aperture therethrough, flush with the inner surface of the combustion chamber cavity, and also providing oxidizer nozzles as a plurality of radial grooves on the distal side of the flat plate, whereby the fuel and oxidizer are injected in a generally inward direction.

5. A surrogate weapon according to claim 1 in which the fuel and oxidizer manifold is integral with the head wall, whereby the headwall is cooled by the flow of fuel and oxidizer.

6. A surrogate weapon according to claim 1 in which the primary combustion chamber has a concave head wall.

7. A surrogate weapon according to claim 6 in which the concave head wall is at least partly in the form of an elipsoid having a first focus within the chamber and a second conjugate focus at or beyond the open end of the chamber.

8. A surrogate weapon according to claim 6 in which the concave head wall is at least partly in the form of a paraboloid having a focus within the chamber.

9. A surrogate weapon according to claim 6 in which a portion of the chamber is a truncated cone having its larger end joined to the concave reflector.

10. A surrogate weapon according to claim 1 in which the primary combustion chamber is provided with a annular, truncated conical collar disposed within its distal end, and having a minor diameter smaller than the diameter of the primary combustion chamber.

11. A surrogate weapon according to claim 1 in which the means for ignition is a spark plug having its electrodes extending through one wall into the primary combustion chamber near the outlet of the fuel or oxidizer nozzles.

12. A surrogate weapon according to claim 1 in which the source of ignition is a spark plug having its electrodes extending in the distal direction through the head wall on the central axis of the primary combustion chamber.

13. A surrogate weapon according to claim 1 in which the means for injecting the fuel and oxidizer is a first plurality of circumferentially spaced radial fuel nozzles, and a second plurality of circumferentially spaced radial oxidizer nozzles, said nozzles having their tips flush with the inner surface of the tubular portion of the chamber and emitting fuel and oxidizer in the radially inward direction toward the central axis of the chamber.

14. A surrogate weapon according to claim 1 in which the axial spacing of the fuel nozzles from the oxidizer nozzles produces an axially stratified mixture distribution within the primary combustion chamber, with a richer fuel concentration near the spark plug that is within the flammability limits of the mixture, and upon ignition propagates a combustion deflagration wave that transitions to a detonation wave in the rest of the mixture, which is within the flammability limits of detonation combustion.

15. A surrogate weapon according to claim 3 in which the fuel nozzles are in a plane normal to the axis of the chamber, and are disposed along radials from the axis of the chamber, whereby the nozzles emit fuel in a straight radially inward pattern; and the oxidizer nozzles are in a plane axially spaced in the distal direction and normal to the axis of the chamber, disposed at an angle with respect to the radials whereby the nozzles emit oxidizer in a swirl pattern, and in which the angle of the oxidizer nozzles is large enough to generate sufficient swirl to produce a radially stratified mixture wherein the fuel concentration near the spark plug on the central axis of the primary combustion chamber is sufficiently rich to provide deflagrative combustion and which will transition to detonative combustion in the rest of the mixture in the primary and secondary combustion chambers.

16. A surrogate weapon according to claim 3 in which the fuel nozzles are in a plane normal to the axis of the chamber, and are disposed along radials from the axis of the chamber, whereby the nozzles emit fuel in a straight radially inward pattern; and the oxidizer nozzles are in a plane axially spaced in the distal direction and normal to the axis of the chamber, disposed at an angle with respect to the radius whereby the nozzles emit oxidizer in a swirl pattern, and in the axial spacing between the fuel nozzles and the oxidizer nozzles is larger enough to produce an axially stratified mixture, and the angle of the oxidizer nozzles is large enough to generate sufficient swirl to produce a radially stratified mixture, wherein the fuel concentration near the spark plug is sufficiently rich to provide deflagrative combustion and which will transition in both the radial and axial directions to detonative combustion in the rest of the mixture in the primary and secondary combustion chambers.

17. A surrogate weapon according to claim 4 in which the flat plate is disposed between the tubular position of the chamber and the concave energy reflector.

18. A surrogate weapon according to claim 17 in which at least one fuel passage is provided through the concave energy reflector to the fuel nozzle grooves in the flat plate, and at least one oxidizer passage is provided through the concave energy reflector to the oxidizer nozzle grooves in the flat plate.

19. A surrogate weapon according to claim 18 in which the flat nozzle plate and the concave reflector are made of a heat conductive metal and are compressively joined in thermal contact.

20. A surrogate weapon according to claim 1 in which the fuel is Methane and the oxidizer is Oxygen.

21. A surrogate weapon according to claim 1 in which the fuel and oxidizer are injected through the nozzles at least at sonic velocity.

22. A surrogate weapon according to claim 1 in which the secondary chamber muzzle is generally the same diameter as the secondary chamber.

23. A surrogate weapon according to claim 1 in which the secondary chamber muzzle is smaller in diameter than the secondary chamber.

24. A surrogate weapon according to claim 1 in which the secondary chamber muzzle is larger in diameter than the secondary chamber.

25. A surrogate weapon according to claim 23 in which the secondary chamber muzzle has an annular, truncated conical entrance shape.

26. A surrogate weapon according to claim 23 in which the secondary chamber muzzle has an annular, truncated conical entrance shape and an annular, truncated conical exit shape.

27. A surrogate weapon according to claim 24 in which the secondary chamber muzzle has an annular, truncated conical exit shape.

28. A surrogate weapon according to claim 1 in which the trigger means initiates a timed pulse sequence as follows:

Fuel valve opens
Oxidizer valve opens
Fuel valve closes
Ignitor operates
Oxidizer valve closes
Ignitor operates again.

29. A surrogate weapon according to claim 1 in which the trigger means initiates a timed pulse sequence as follows:

Fuel and oxidizer valves open
Fuel valve closes
Ignitor operates
Oxidizer valve closes
Ignitor operates again.

30. A surrogate weapon according to claim 1 in which the trigger means initiates a timing pulse sequence generally as follows:

| | |
|---|---|
| Fuel valve opens | 0.000 seconds |
| Oxidizer valve opens | 0.030 seconds |
| Fuel valve closes | 0.060 seconds |
| Ignitor operates | 0.066 seconds |
| Oxidizer valve closes | 0.072 seconds |
| Ignitor operates | 0.075 seconds |

* * * * *